US010915052B2

(12) United States Patent
Azami et al.

(10) Patent No.: US 10,915,052 B2
(45) Date of Patent: Feb. 9, 2021

(54) RECORDING MATERIAL DETERMINATION APPARATUS AND IMAGE FORMING APPARATUS THAT RECEIVE ULTRASONIC WAVES

(71) Applicant: CANON KABUSHIKI KAISHA, Tokyo (JP)

(72) Inventors: Junya Azami, Mishima (JP); Masafumi Monde, Kawasaki (JP); Hiromitsu Kumada, Suntou-gun (JP); Yuka Fujii, Yokohama (JP); Mizuki Ishimoto, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/717,130

(22) Filed: Dec. 17, 2019

(65) Prior Publication Data

US 2020/0209794 A1 Jul. 2, 2020

(30) Foreign Application Priority Data

Dec. 26, 2018 (JP) ..... 2018-242686
Aug. 27, 2019 (JP) ..... 2019-155098

(51) Int. Cl.
*G03G 15/00* (2006.01)

(52) U.S. Cl.
CPC ..... *G03G 15/5029* (2013.01); *G03G 2215/00742* (2013.01)

(58) Field of Classification Search
CPC ..... G03G 15/5029; G03G 2215/00738; G03G 2215/00742
See application file for complete search history.

(56) References Cited

U.S. PATENT DOCUMENTS

2011/0142461 A1* 6/2011 Nakamura ..... G03G 15/5029 399/45
2014/0091516 A1* 4/2014 Okitsu ..... B65H 7/125 271/262
2017/0013363 A1* 1/2017 Berger ..... H04R 19/04

FOREIGN PATENT DOCUMENTS

JP 2010-018432 A 1/2010
JP 2010-018433 A 1/2010
JP 2013-056771 A 3/2013
JP 2017-504279 A 2/2017
JP 2018-514980 A 6/2018

* cited by examiner

*Primary Examiner* — Carla J Therrien
(74) *Attorney, Agent, or Firm* — Canon U.S.A., Inc. I.P. Division

(57) ABSTRACT

A recording material determination apparatus includes a transmission unit, a reception unit, and a determination unit. The transmission unit transmits an ultrasonic wave to a recording material. The reception unit vibrates when the reception unit receives the ultrasonic wave having been transmitted from the transmission unit and having passed through the recording material, and outputs a signal corresponding to a vibration state. The determination unit determines a basis weight of the recording material in accordance with the signal output from the reception unit. A resonance frequency of the reception unit differs from a resonance frequency of the transmission unit, and the reception unit is capable of receiving a sound wave in an ultrasonic range and a sound wave in an audible range.

22 Claims, 7 Drawing Sheets

RECORDING MATERIAL DETERMINATION APPARATUS AND IMAGE FORMING APPARATUS THAT RECEIVE ULTRASONIC WAVES

BACKGROUND

Field

The present disclosure relates to a technique for detecting a basis weight of a recording material with high accuracy.

Description of the Related Art

In the related art, some image forming apparatuses, such as copying machines and printers, include therein a sensor for determining the type of a recording material. These apparatuses automatically determine the type of the recording material and control, in accordance with a determination result, transfer conditions (for example, a transfer voltage, and/or a conveyance speed of the recording material during transfer), and fixing conditions (for example, a fixing temperature, and/or a conveyance speed of the recording material during fixing).

Japanese Patent Laid-Open No. 2010-18432 discloses an image forming apparatus including an ultrasonic sensor that detects a grammage or basis weight of a recording material by transmitting an ultrasonic wave to the recording material and receiving the ultrasonic wave having passed through the recording material and been attenuated. A transmitting unit and a receiving unit that are included in the ultrasonic sensor have the same configuration and each include a vibration member and a piezoelectric element. In the transmitting unit, a drive signal is transmitted to the piezoelectric element to vibrate the vibration member, and an ultrasonic wave is thereby transmitted. In the receiving unit, the vibration member that has received the ultrasonic wave vibrates, and the piezoelectric element converts the vibration of the vibration member into a reception signal.

Japanese Patent Laid-Open No. 2013-56771 discloses a configuration in which a recording material is subjected to detection by an ultrasonic sensor while the recording material is being conveyed. This enables a plurality of portions of the same recording material to be subjected to detection using ultrasonic waves. In general, a grammage or basis weight of a recording material is not uniform. When a plurality of portions are compared in terms of grammage or basis weight, there are differences among them. For this reason, in comparison with the case where a grammage or basis weight of a recording material is determined in accordance with a detection result for one portion of the recording material, the case where a grammage or basis weight of the recording material is determined in accordance with detection results for a plurality of portions increases the accuracy of determining the grammage or basis weight.

The ultrasonic sensor disclosed in Japanese Patent Laid-Open No. 2010-18432 is widely used, and there is provided a configuration in which a piezoelectric ceramic serving as a piezoelectric element is bonded to a vibration member. In an ultrasonic reception unit having such a configuration, a frequency at which practical reception sensitivity is obtained is limited to a frequency close to a resonance frequency of a system including a vibration member and a piezoelectric ceramic. In many cases, little reception sensitivity is obtained at a frequency other than the frequency. For this reason, an ultrasonic sensor having the above-described configuration has to be used at a frequency (40 kHz in Japanese Patent Laid-Open No. 2010-18432) close to a resonance frequency.

Although the ultrasonic sensor disclosed in Japanese Patent Laid-Open No. 2010-18432 exhibits high reception sensitivity at a frequency close to a resonance frequency, reverberation due to resonance occurs, and it takes time before a signal value output from the receiving unit converges. For this reason, in the case where ultrasonic detection is performed a plurality of times as described in Japanese Patent Laid-Open No. 2013-56771, a next detection operation is not able to be performed until a reception signal converges, and, as a result, the number of times ultrasonic detection is performed on the same recording material is restricted.

SUMMARY

According to an aspect of the present disclosure, a recording material determination apparatus includes a transmission unit configured to transmit an ultrasonic wave to a recording material, a reception unit configured to vibrate when the reception unit receives the ultrasonic wave having been transmitted from the transmission unit and having passed through the recording material and configured to output a signal corresponding to a vibration state, and a determination unit configured to determine a basis weight of the recording material in accordance with the signal output from the reception unit, wherein a resonance frequency of the reception unit differs from a resonance frequency of the transmission unit, and the reception unit is capable of receiving a sound wave in an ultrasonic range and a sound wave in an audible range.

Further features of the present disclosure will become apparent from the following description of exemplary embodiments with reference to the attached drawings.

DESCRIPTION OF THE EMBODIMENTS

First Embodiment

Configuration of Image Forming Apparatus

Figure 1:
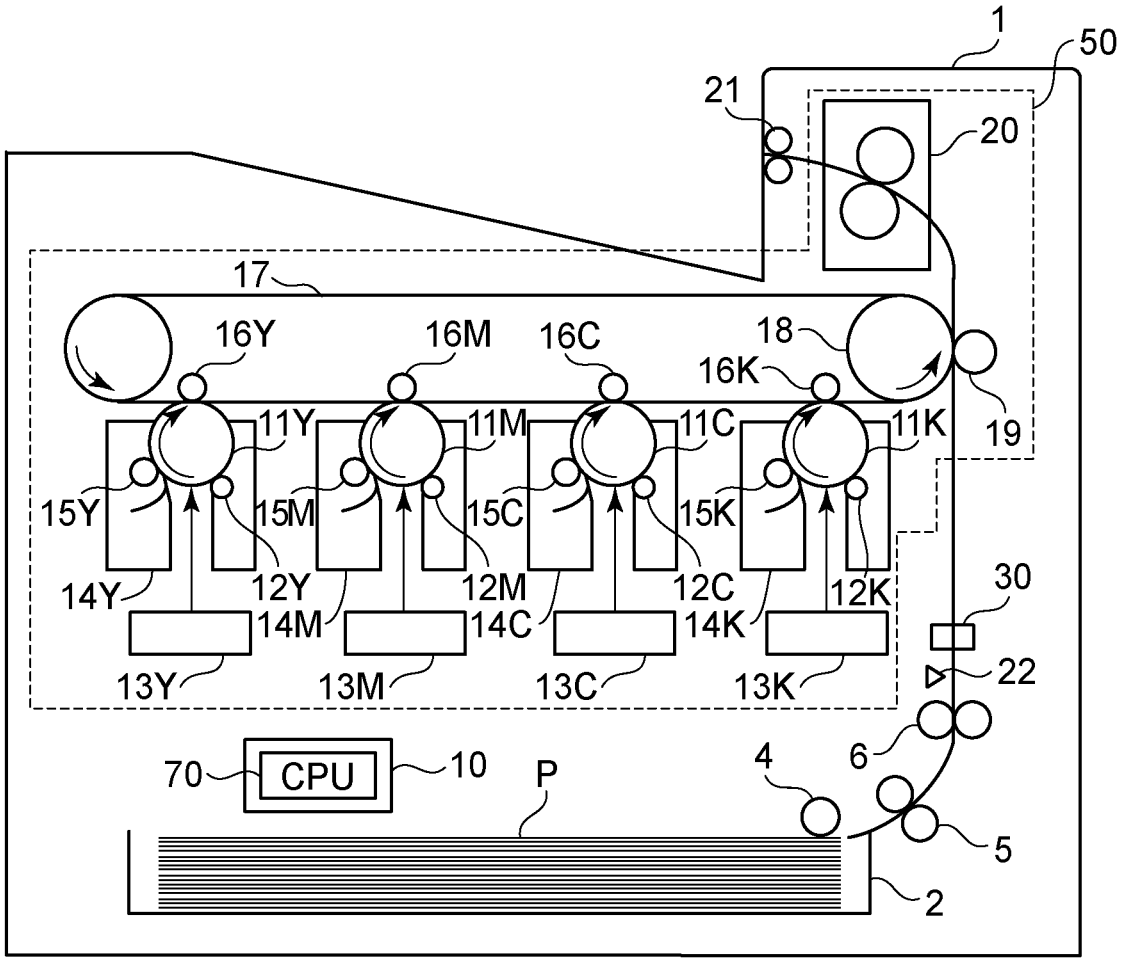
FIG. 1 illustrates a configuration of an image forming apparatus.

An overview of an electrophotographic image forming apparatus to which the present embodiment is applicable will be described. FIG. 1 is a schematic configuration diagram of an image forming apparatus 1 including an image forming unit 50 that uses an intermediate transfer belt 17 and forms an image on a recording material P.

The image forming apparatus 1 is a tandem-type color laser beam printer and is configured to be capable of outputting a color image obtained by superimposing toners, which are developers of four colors of yellow (Y), magenta (M), cyan (C), and black (K). A cassette 2 contains the recording material P. In the image forming apparatus 1, there are provided a supply roller 4 that supplies the recording material P from the cassette 2, a conveyance roller pair 5 that conveys the recording material P supplied by the supply roller 4, and a registration roller pair 6. In the proximity of the registration roller pair 6, a registration sensor 22 is provided that detects leading and trailing edges of the recording material P and monitors a position of the leading edge of the recording material P.

Photosensitive drums 11 (11Y, 11M, 11C, and 11K) bear toners of the respective colors. Charging rollers 12 (12Y, 12M, 12C, and 12K) for the respective colors charge the photosensitive drums 11 uniformly to a predetermined potential. Laser scanners 13 (13Y, 13M, 13C, and 13K) are laser scanners for the respective colors. Process cartridges 14 (14Y, 14M, 14C, and 14K) visualize electrostatic latent images formed on the respective photosensitive drums 11 by the respective laser scanners 13. Development rollers 15 (15Y, 15M, 15C, and 15K) convey toners contained in the respective process cartridges 14 to the respective photosensitive drums 11. Primary transfer rollers 16 (16Y, 16M, 16C, and 16K) primarily transfer the images formed on the respective photosensitive drums 11 onto the intermediate transfer belt 17.

The intermediate transfer belt 17 is driven by a drive roller 18 and rotates. A secondary transfer roller 19 transfers the images formed on the intermediate transfer belt 17 onto the recording material P. The drive roller 18 and the secondary transfer roller 19 form a nip therebetween, and the images formed on the intermediate transfer belt 17 are transferred onto the recording material P while the recording material P is being pinched and conveyed by the nip. A fixing unit 20 fuses and fixes toner images secondarily transferred onto the recording material P while conveying the recording material P. The above-described photosensitive drums 11 to fixing unit 20 constitute an example of the image forming unit 50. A discharge roller pair 21 discharges the recording material P subjected to fixing by the fixing unit 20 to the outside of the image forming apparatus 1. Furthermore, the supply roller 4, the conveyance roller pair 5, the registration roller pair 6, the drive roller 18, the secondary transfer roller 19, the fixing unit 20, and the discharge roller pair 21 that are disposed along a conveyance path for the recording material P, and a motor (not illustrated) that drives these elements constitute an example of a conveyance unit that conveys the recording material P.

A detection unit 30 detects a basis weight, which is a property of the recording material P. The detection unit 30 is disposed upstream from the secondary transfer roller 19 in a conveyance direction of the recording material P and is capable of detecting a basis weight of the recording material P conveyed from the cassette 2. In the present embodiment, a detection operation performed by the detection unit 30 is performed a plurality of times in a time period during which the recording material P is being conveyed by the above-described conveyance unit, and a plurality of portions in the conveyance direction of the recording material P are subjected to detection by the detection unit 30.

In a control unit 10, for example, a micro processing unit (MPU) (not illustrated) including a central processing unit (CPU) 70 and so forth, a random-access memory (RAM) (not illustrated) used, for example, for calculation and temporary storage of data involved in controlling the image forming apparatus 1, and a read only memory (ROM) (not illustrated) storing a program for controlling the image forming apparatus 1 and various pieces of data are incorporated. Furthermore, the control unit 10 controls an electrophotographic process and is also a determination unit that determines a basis weight of the recording material P in accordance with information detected by the detection unit 30. The control unit 10 determines a print mode corresponding to the determined basis weight of the recording material P and controls various image forming conditions.

Here, a relationship between a basis weight of the recording material P and image forming conditions will be described. In general, a resistance value of the recording material P differs according to a basis weight of the recording material P, and thus transfer conditions, such as a voltage value applied to the secondary transfer roller 19 to transfer toner in accordance with the basis weight of the recording material P, have to be changed. Furthermore, a heat capacity of the recording material P differs according to a basis weight of the recording material P, and thus fixing conditions, such as a fixing temperature, a fixing time period, and a conveyance speed for fixing toner in accordance with the basis weight of the recording material P, have to be changed. Thus, a basis weight of the recording material P is determined in accordance with information detected by the detection unit 30, and image forming conditions are set in accordance with the determined basis weight, thereby allowing an image of high quality to be formed on the recording material P.

Although, in the above-described description, the control unit 10 determines a basis weight of the recording material P in accordance with a detection result obtained by the detection unit 30 and sets image forming conditions corresponding to the determined basis weight of the recording material P, a process of determining a basis weight of the recording material P does not have to be performed. The control unit 10 may set image forming conditions directly in accordance with a detection result obtained by the detection unit 30.

Configuration of Detection Unit

Figure 2B:
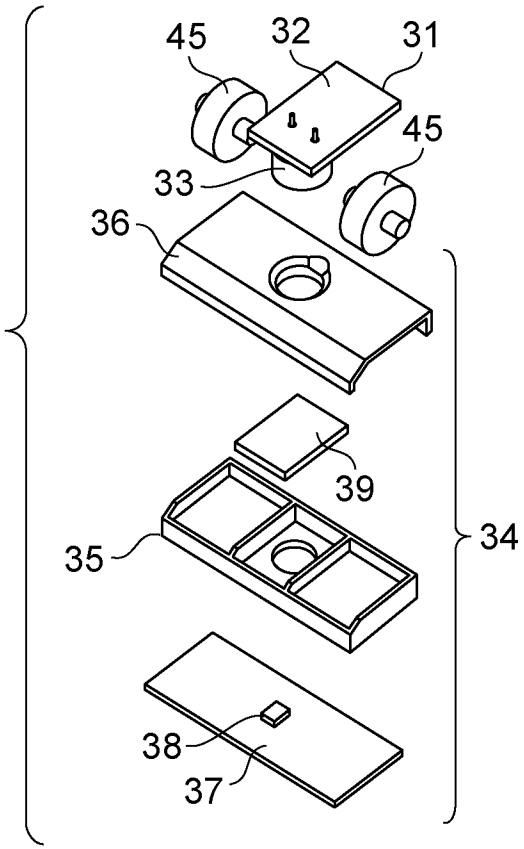
FIGS. 2A and 2B are a cross-sectional view and an exploded perspective view of a detection unit.
Figure 2A:
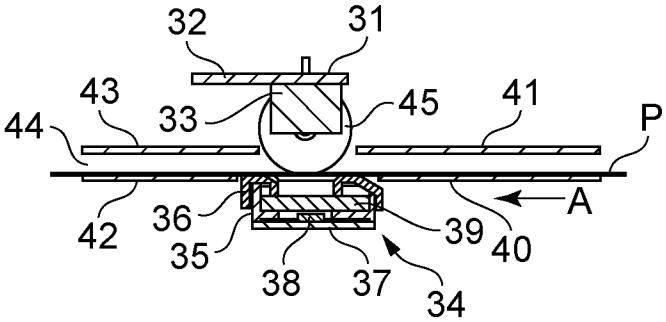

A configuration of the detection unit 30 according to the present embodiment will be described with reference to FIGS. 2A and 2B. FIGS. 2A and 2B are a cross-sectional view and an exploded perspective view of the detection unit 30.

A transmission unit 31 is constituted by a transmission circuit substrate 32 and an ultrasonic transmitter 33 and transmits an ultrasonic wave. The ultrasonic transmitter 33 in the present embodiment is constructed by bonding a piezoelectric ceramic to a vibration member (not illustrated). A reception unit 34 is constituted by a housing 35, a cover 36, a reception circuit substrate 37, a micro-electro-mechanical system (MEMS) microphone 38, and a filter 39 and receives the ultrasonic wave transmitted from the transmission unit 31. Here, the filter 39 is made of urethane foam or nonwoven fabric and is capable of passing sound (air), but does not pass dust particles, such as paper dust. The filter 39 keeps a sound hole provided in the MEMS microphone 38 to be described from being blocked, for example, with paper dust. Conveyance guides 40, 41, 42, and 43 constitute a conveyance path 44 for the recording material P, and the recording material P is conveyed in the direction of an arrow A in FIG. 2A. Urging rollers 45 press the recording material P against the cover 36 to keep the recording material P from fluttering during conveyance.

Figure 3:
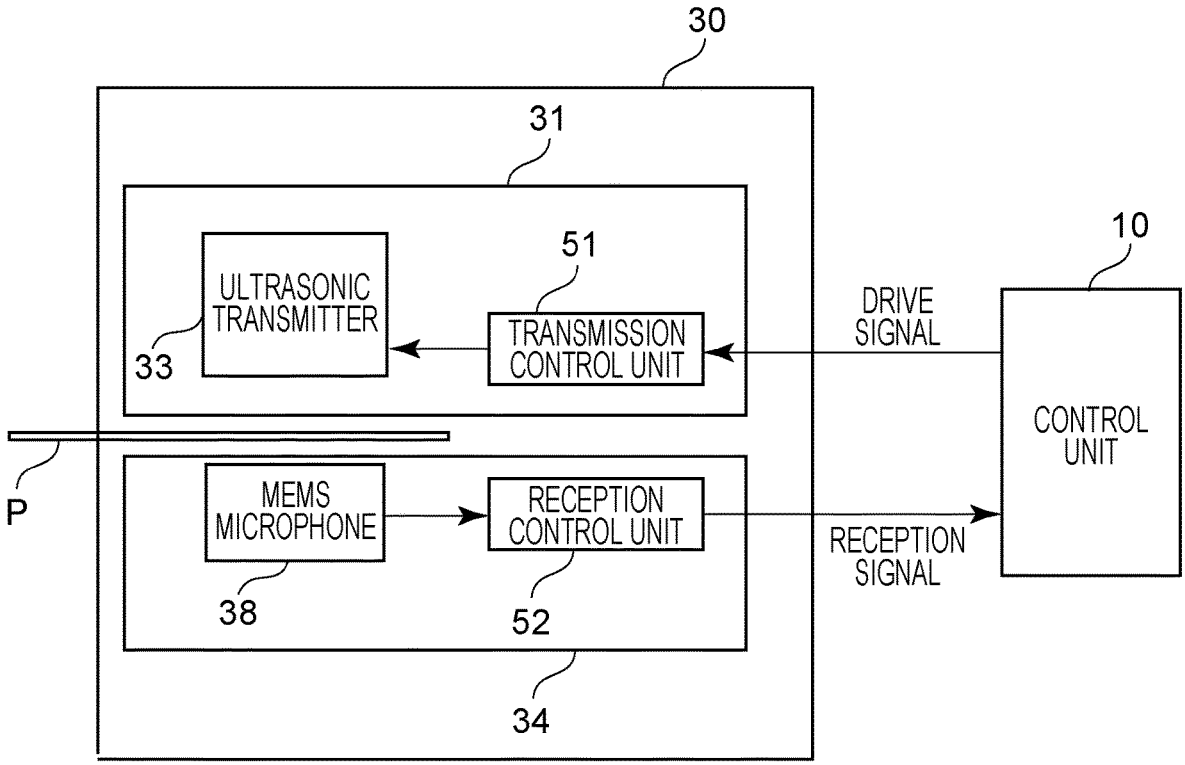
FIG. 3 is a control block diagram of the detection unit and a control unit.

An overview of the operation of the detection unit 30 will be described with reference to a block diagram of FIG. 3. As described above, the control unit 10 determines a basis weight of the recording material P in accordance with a detection result obtained by the detection unit 30. Subsequently, the control unit 10 sets image forming conditions corresponding to the basis weight of the recording material P and performs control concerning an image forming operation including control of a drive source involved in the conveyance of the recording material P.

The ultrasonic transmitter 33 is an element capable of emitting a sound wave with a frequency of 40 kHz in accordance with a certain incoming signal. The MEMS microphone 38 is an element capable of receiving the sound wave emitted from the ultrasonic transmitter 33 and outputs a reception signal corresponding to the sound pressure of the received sound wave. In the present embodiment, the frequency of a sound wave is 40 kHz but is not limited to this, and any frequency at which a basis weight of the recording material P can be detected may be used. Furthermore, the ultrasonic transmitter 33 and the MEMS microphone 38 are disposed opposite each other with the conveyance path for the recording material P interposed therebetween so that the sound wave having passed through the recording material P can be received.

A transmission control unit 51 is disposed on the transmission circuit substrate 32 and has a function of amplifying a drive signal from the control unit 10 and driving the ultrasonic transmitter 33. A reception control unit 52 is disposed on the reception circuit substrate 37 and has a function of passing, of a signal from the MEMS microphone 38, a signal component only in a specific frequency band in the vicinity of 40 kHz, which is a frequency of a sound wave from the ultrasonic transmitter 33, and subjecting the signal component to amplification and half-wave rectification. As a unit that implements a function of passing a signal component only in a specific frequency band, for example, an active filter circuit using an operational amplifier may be used, or a passive filter circuit using a capacitor and a coil may be used. Any unit can be used that attenuates another sound with a frequency other than a frequency desired to be obtained and can detect a signal component of a sound wave from the ultrasonic transmitter 33 with a desired or higher degree of accuracy. For example, the reception control unit 52 does not have the function, and a digital filter using the control unit 10 may be used. A reception signal generated by the reception control unit 52 is input to an analog-to-digital (AD) port of the control unit 10, and the control unit 10 detects a waveform of the reception signal in accordance with a converted digital value and extracts a peak value of the waveform as a reception level.

Figure 4:
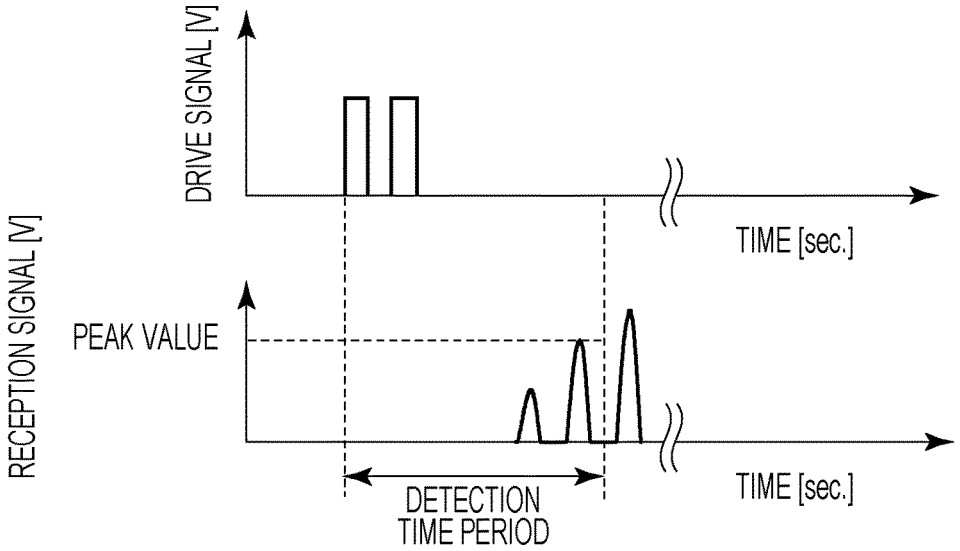
FIG. 4 illustrates waveforms of a drive signal and a reception signal.

A method of extracting a reception level will be described with reference to a timing diagram of FIG. 4. A drive signal is a pulse wave (burst wave) with a constant period, a frequency is 40 kHz, and the number of pulses is two. A reception signal generated by the reception control unit 52 has a waveform having a peak value every half wave of 40 kHz, which is the same as a frequency of a sound wave of the ultrasonic transmitter 33, in accordance with the sound pressure of the sound wave received by the MEMS microphone 38. Furthermore, the number of waveforms of the reception signal is above two even if the number of pulses of the drive signal is two. This is mainly because of the influence of reverberation. The control unit 10 detects a second waveform of the reception signal and extracts a peak value of the second waveform. At this time, detection of the peak value of the second waveform is performed by detecting the reception signal in a range of a certain detection time period synchronized with the drive signal. Here, the length of the detection time period is pre-calculated from a relationship between a distance between the ultrasonic transmitter 33 and the MEMS microphone 38 and a sound velocity of an ultrasonic wave and is set.

While the recording material P is being conveyed between the ultrasonic transmitter 33 and the MEMS microphone 38, the control unit 10 transmits a drive signal to the transmission control unit 51 and sequentially extracts peak values while the recording material P is being conveyed. In the present embodiment, the number of pulses of a drive signal is two, and a waveform whose peak value is extracted is a second waveform but is not limited to this. A waveform of a primary wave little influenced by disturbances due to the recording material P and surrounding members only has to be detected. For example, a first waveform may be used, or both the first and second waveforms may be used. Furthermore, a peak value of a waveform is used, but the present disclosure is not limited to this. An output value, such as an effective value or mean value, by which a level of a reception signal can be determined only has to be used.

Configuration of MEMS Microphone

Next, a configuration of the MEMS microphone 38 incorporated in the reception unit 34 will be described in detail. Incidentally, MEMS stands for micro-electro-mechanical system, and the MEMS is an electro-mechanical system constituted by micro-components fabricated by using a semiconductor microfabrication technique.

Figure 5:
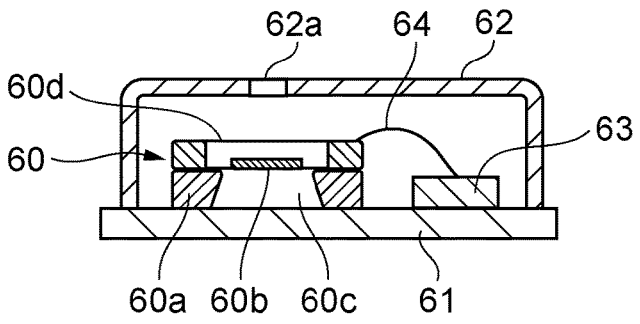
FIG. 5 illustrates a configuration of a MEMS microphone.

FIG. 5 is a cross-sectional view illustrating an example of the MEMS microphone 38. In FIG. 5, a reference numeral 60 denotes a MEMS chip, a reference numeral 61 denotes a substrate, a reference numeral 62 denotes a shield case, and a reference numeral 63 denotes an amplifier circuit. Here, in the shield case 62, there is provided a sound hole 62*a* for allowing a sound wave to enter from outside. The MEMS chip 60 and the amplifier circuit 63 are electrically connected with a wire 64. Furthermore, the MEMS chip 60 is constituted by a vibrating membrane 60*b* formed on a silicon substrate 60*a*, a cavity portion 60*c*, a back electrode 60*d*, and so forth. In the back electrode 60*d*, many sound holes are formed so that an ultrasonic wave reaches the vibrating membrane 60*b*. When a sound wave enters from the sound hole 62*a* provided in the shield case 62, the vibrating membrane 60*b* vibrates, and a change in capacitance between the vibrating membrane 60*b* and the back electrode 60*d* at this time is converted into an electrical signal. That is, the back electrode 60*d* outputs an electrical signal in accordance with a vibration state of the vibrating membrane 60*b*. The electrical signal is transmitted from the back electrode 60*d* to the amplifier circuit 63 through the wire 64, further subjected to amplification processing by the amplifier circuit 63, and then transmitted to the reception control unit 52.

Figure 6:
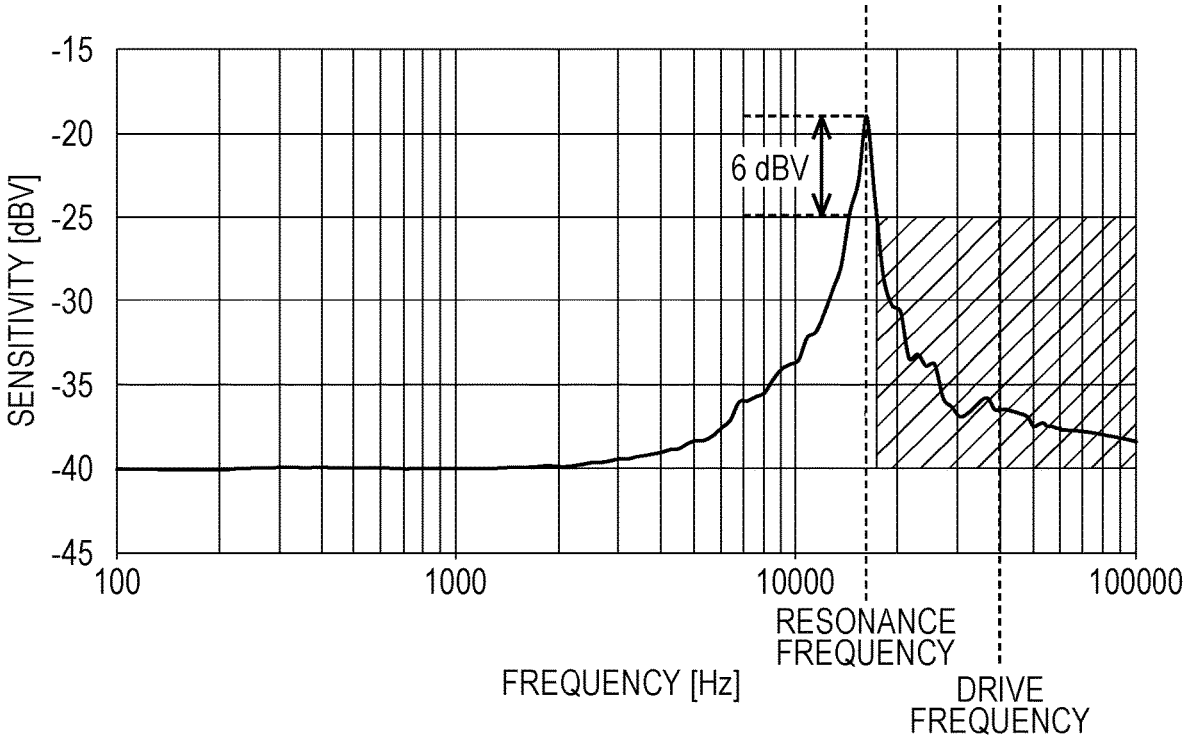
FIG. 6 illustrates a frequency characteristic of the MEMS microphone.

FIG. 6 illustrates an example of a frequency characteristic of the MEMS microphone 38 in the present embodiment. In FIG. 6, the horizontal axis represents frequency of an input sound wave, and the vertical axis represents reception sensitivity of the MEMS microphone 38. Here, the reception sensitivity on the vertical axis is expressed in decibels (e.g., voltage decibels (dBV), and assume that 0 dBV=1 V/Pa (volt/pascal). As described later, a sound wave in an audible range is a sound wave in a frequency band ranging from 20 hertz (Hz) to 20 kHz, and a sound wave in an ultrasonic range is a sound wave in a frequency band greater than 20 kHz. A resonance frequency of the MEMS microphone 38 in the present embodiment is about 15 kHz, and the MEMS microphone 38 has reception sensitivity even at frequencies other than 15 kHz and is usable. For example, a drive frequency of an ultrasonic wave transmitted from the ultrasonic transmitter 33 is about 40 kHz. The MEMS microphone 38 according to the present embodiment has a reception sensitivity not less than −40 dBV even in such a drive frequency band. In the configuration according to the present embodiment, a basis weight can be sufficiently detected in the ultrasonic range as long as the reception sensitivity is not less than −45 dBV. Furthermore, the MEMS microphone 38 in the present embodiment has a reception sensitivity not less than −40 dBV even in a frequency band on a lower side than 15 kHz, that is, in a frequency band in the audible range. In other words, the MEMS microphone 38 in the present embodiment is capable of receiving a sound wave in the ultrasonic range and a sound wave in the audible range. Furthermore, a reception sensitivity of the MEMS microphone 38 at the drive frequency is lower than a reception sensitivity at the resonance frequency by not less than 6 dBV. Owing to this relationship, when the MEMS microphone 38 receives an ultrasonic wave with the drive frequency (about 40 kHz), an output value of a reception signal converges quickly. Incidentally, the resonance frequency of the MEMS microphone 38 is determined in accordance with the volume of the space surrounded by the shield case 62, the size and position of the sound hole 62*a*, and so forth that are illustrated in FIG. 5. In a summary of the above-described conditions, it is desirable that the reception sensitivity of the MEMS microphone 38 at the drive frequency falls within a diagonally shaded area in FIG. 6.

Figure 7A:
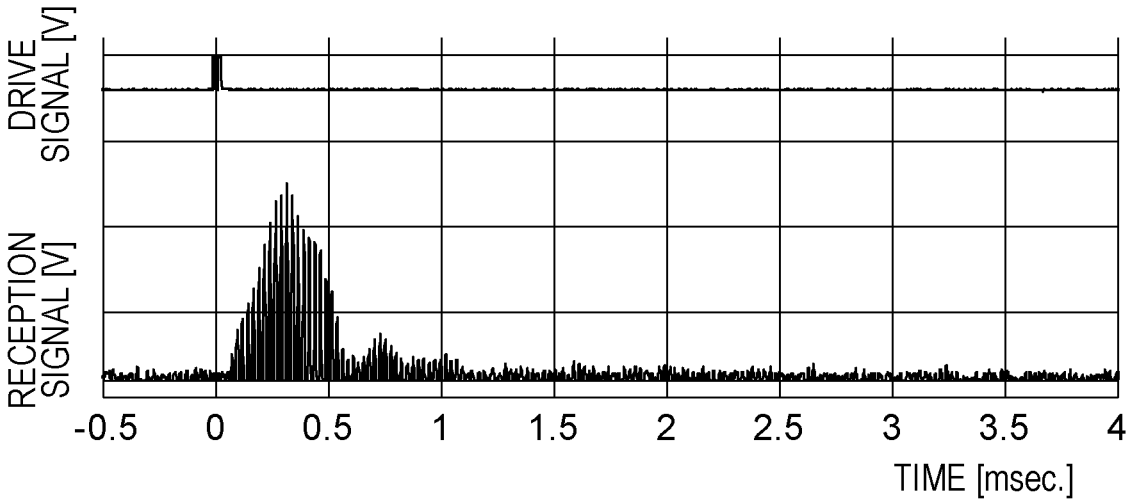
FIGS. 7A and 7B illustrate the behavior of a reception signal until an output value of the reception signal converges.
Figure 7B:
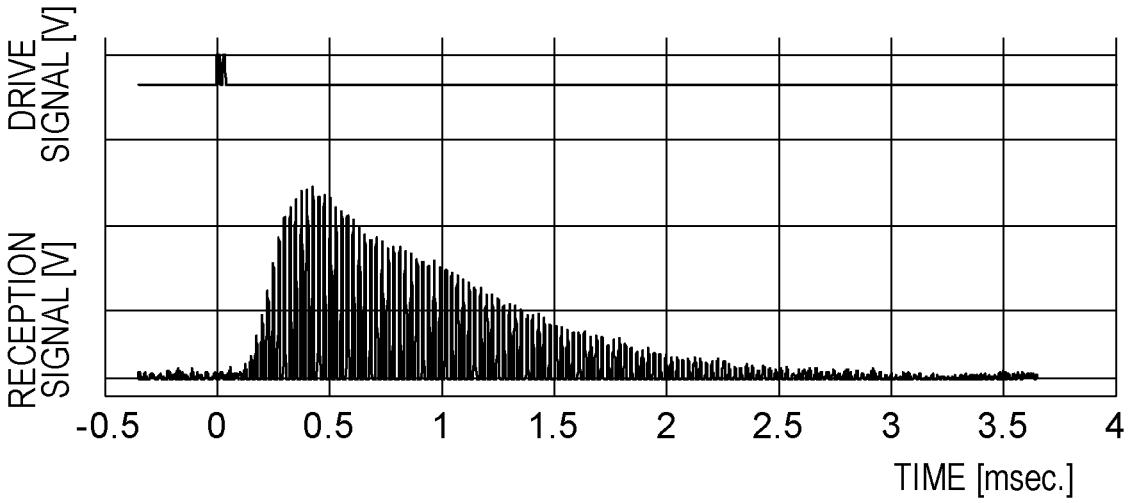

FIGS. 7A and 7B are graphs illustrating attenuation of output of a reception signal. FIG. 7A illustrates a waveform of a reception signal in the case where the MEMS microphone 38 in the present embodiment is used in the reception unit 34. FIG. 7B illustrates a waveform of a reception signal in the case where an existing sensor using a piezoelectric ceramic is used in the reception unit 34. In each graph, the horizontal axis represents time, and the vertical axis represents output value of the reception signal. As is apparent from FIG. 7A, when the MEMS microphone 38 is used, an output waveform converges in about 1.5 msec. This is about half the time taken when the existing sensor using a piezoelectric ceramic is used as illustrated in FIG. 7B. In the case of the MEMS microphone 38, a sound wave (about 40 kHz) in a frequency band above or below the resonance frequency (about 15 kHz) is received, and the output value of the reception signal thus converges quickly.

Figure 8:
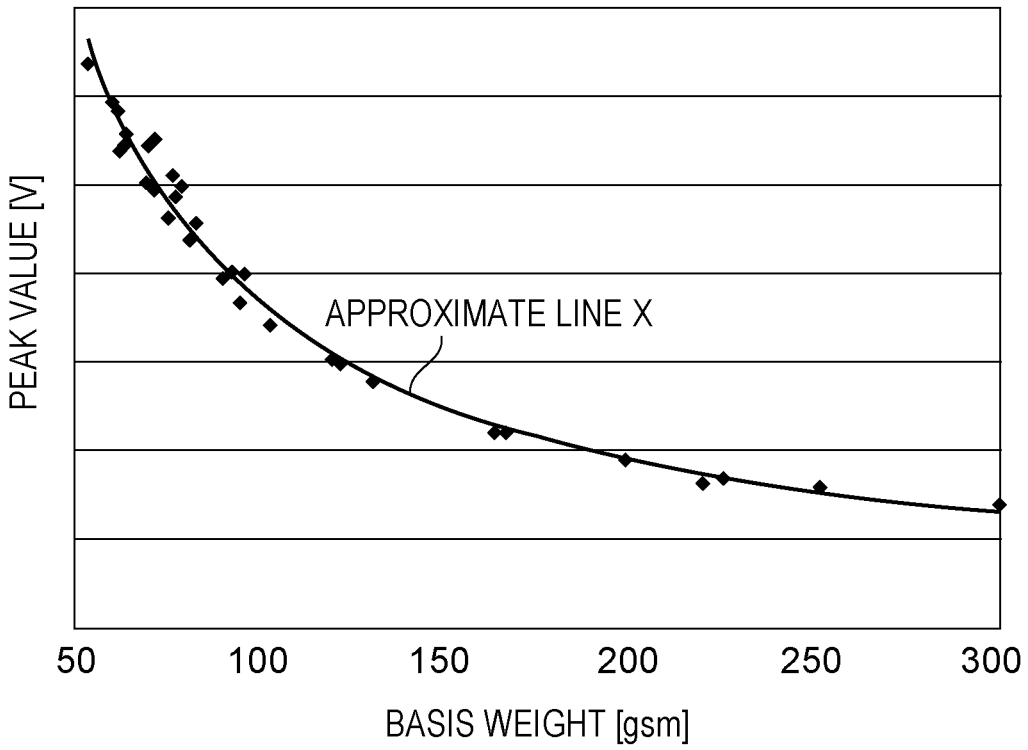
FIG. 8 illustrates a relationship between a basis weight of a recording material and a peak value of a reception signal.

FIG. 8 is a graph illustrating a relationship between a value of a basis weight of the recording material P actually measured by an electronic balance and a peak value of a reception signal when the MEMS microphone 38 is used. It is seen that, as the basis weight of the recording material P increases, the peak value decreases. This is because, as the basis weight of the recording material P increases, attenuation of an ultrasonic wave that passes through the recording material P increases. Hence, the control unit 10 can determine a basis weight of the recording material P from a peak value of the reception signal by using an expression of an approximate line X illustrated in FIG. 8.

Flowchart Illustrating Operation of Detection Unit 30

Figure 9:
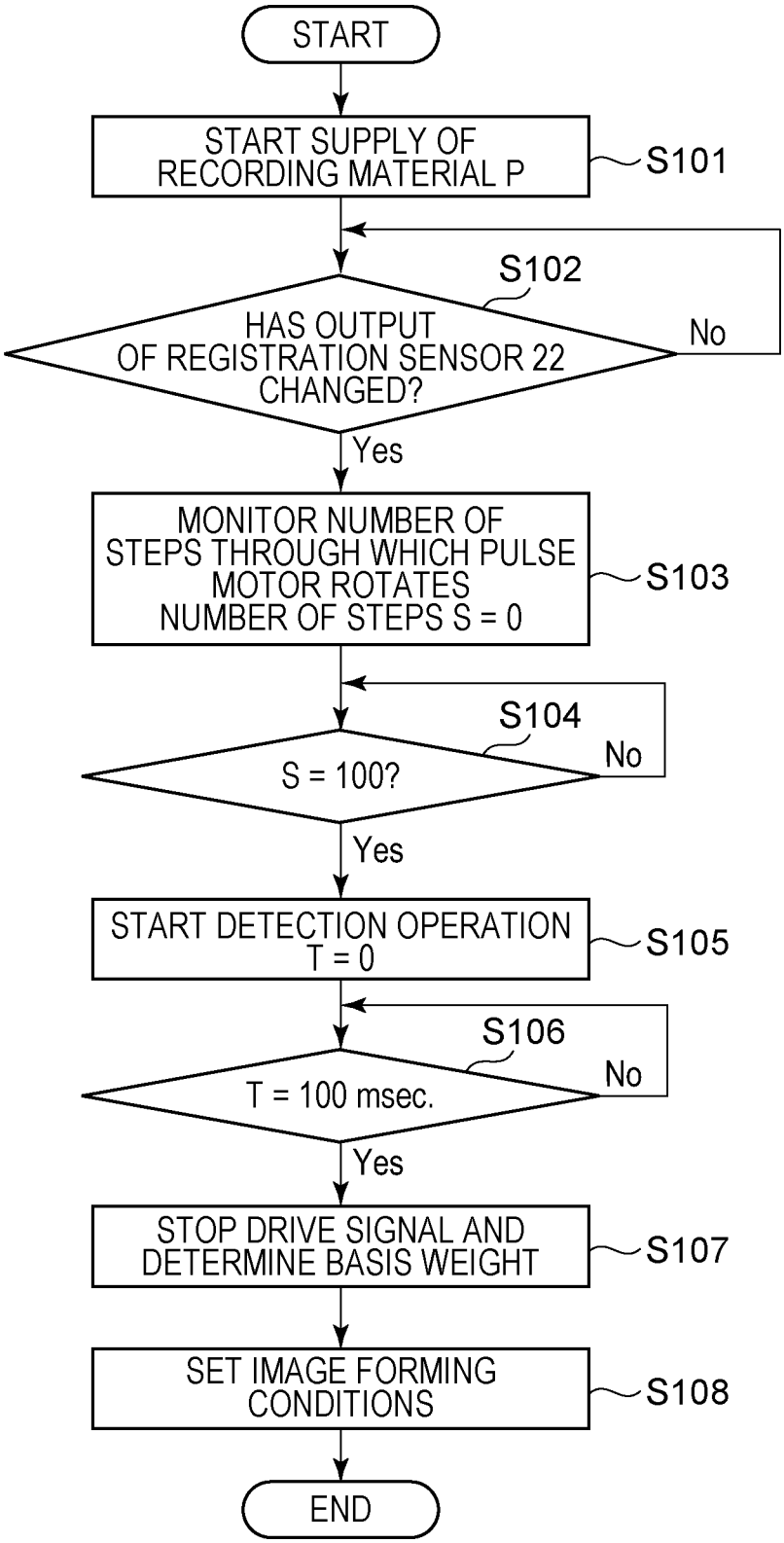
FIG. 9 is a flowchart illustrating operation up to setting of image forming conditions.

FIG. 9 is a flowchart illustrating operation up to setting of image forming conditions after determination of a basis weight of the recording material P. Control based on the flowchart illustrated in FIG. 9 is performed by the control unit 10 in accordance with a program stored in the ROM (not illustrated) or the like.

After the control unit 10 receives a print instruction, the control unit 10 starts conveyance of the recording material P and an image forming operation (S101). The recording material P is supplied from the cassette 2 by the supply roller 4 and conveyed by the conveyance roller pair 5 and the subsequent registration roller pair 6. Here, the registration roller pair 6 is rotated by a pulse motor (not illustrated). At a point in time when a leading edge of the recording material P passes through the registration roller pair 6, output of the registration sensor 22 changes (S102), and the control unit 10 starts to count, in response to the change, the number of steps through which the pulse motor rotates (S103). When the pulse motor rotates through 100 steps (S104) from a point in time when the output of the registration sensor 22 has changed (S=0), the control unit 10 determines that the leading edge of the recording material P has reached the detection unit 30. The control unit 10 resets a timer count T made by an internal timer, outputs a drive signal for burst driving, and causes a detection operation to be started (S105). Here, the detection operation refers to an operation in which the ultrasonic transmitter 33 transmits an ultrasonic wave to the recording material P and the control unit 10 extracts a peak value of a reception signal output from the MEMS microphone 38. After the detection operation is performed for a period of 100 milliseconds (ms) (S106), the control unit 10 stops the drive signal and determines a basis weight of the recording material P from a detection result obtained by the detection operation (S107). The control unit 10 further sets image forming conditions corresponding to the determined basis weight of the recording material P and subjects the recording material P to image forming in accordance with the set image forming conditions (S108). The control based on the flowchart ends.

As described above, in the present embodiment, a sensor that is capable of receiving a sound wave in an ultrasonic range and a sound wave in an audible range and has reception sensitivity even in a frequency band above or below a resonance frequency, for example, the MEMS microphone 38 is used in the reception unit 34 for ultrasonic waves, and an output value of a reception signal thus converges quickly in comparison with the related art. For this reason, a next detection operation can be performed at an earlier point in time, and a time interval between ultrasonic wave irradiation operations can be reduced. Since the time interval between ultrasonic wave irradiation operations can be reduced, the number of times detection is performed in one recording material P can be increased, and the stability of detected data can be increased by performing an averaging process on many pieces of detected data.

Furthermore, spatial resolution can be increased when variations in one recording material P are detected, and thus a basis weight can be determined with higher accuracy. Hence, the accuracy of determining a basis weight of the recording material P can be increased, and image forming conditions are set in accordance with the determined basis weight, thereby allowing an image of high quality to be formed on the recording material P.

In the above-described embodiment, although a configuration is used in which the detection unit 30 is fixed to the image forming apparatus 1, a configuration may be used in which the detection unit 30 is detachable from the image forming apparatus 1. The configuration in which the detection unit 30 is detachable can facilitate replacement made by a user, for example, in the event of a breakdown in the detection unit 30. Alternatively, a configuration may be used in which the detection unit 30 can be installed as an additional element in or on the image forming apparatus 1.

Furthermore, in the above-described embodiment, a configuration may be used in which the detection unit 30 and the control unit 10 are integrated as a recording material determination apparatus and in which the recording material determination apparatus is detachable from the image forming apparatus 1. Thus, if the recording material determination apparatus into which the detection unit 30 and the control unit 10 are integrated is replaceable, in the case where a function of the detection unit 30 is updated or added, the user can easily make replacement with a sensor having a new function. Alternatively, a configuration may be used in which the recording material determination apparatus into which the detection unit 30 and the control unit 10 are integrated can be installed as an additional element in or on the image forming apparatus 1.

Furthermore, in the above-described embodiment, although an example of a laser beam printer has been described, an image forming apparatus to which the present disclosure is applied is not limited to this and may be a printer using another printing method, such as an ink-jet printer, or a copying machine.

Furthermore, in the above-described embodiment, although an example of a MEMS microphone has been described, the present disclosure is not limited to this, and, for example, a capacitor microphone other than the MEMS microphone may be used.

In the present disclosure, the number of times ultrasonic detection is performed on a recording material is increased, thereby allowing an increase in the accuracy of determining a basis weight of the recording material.

Embodiment(s) of the present disclosure can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may include one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random access memory (RAM), a read-only memory (ROM), a storage of distributed computing systems, an optical disk (such as a compact disc (CD), digital versatile disc (DVD), or Blu-ray Disc (BD)™), a flash memory device, a memory card, and the like.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Applications No. 2018-242686, filed Dec. 26, 2018, and No. 2019-155098, filed Aug. 27, 2019, which are hereby incorporated by reference herein in their entirety.

What is claimed is:

1. A recording material determination apparatus comprising:

a transmission unit configured to transmit an ultrasonic wave to a recording material;

a reception unit configured to vibrate when the reception unit receives the ultrasonic wave having been transmitted from the transmission unit and having passed through the recording material, and configured to output a signal corresponding to a vibration state; and a determination unit configured to determine a basis weight of the recording material in accordance with the signal output from the reception unit, wherein a resonance frequency of the reception unit differs from a resonance frequency of the transmission unit, and the resonance frequency of the reception unit is in a range of an audible sound.

2. The recording material determination apparatus according to claim 1, wherein a first reception sensitivity of the reception unit at a frequency of the ultrasonic wave transmitted from the transmission unit is not less than −45 voltage decibels (dBV) and is lower than a second reception sensitivity at the resonance frequency of the reception unit by not less than 6 dBV.

3. The recording material determination apparatus according to claim 1, wherein the reception unit includes a vibrating membrane configured to vibrate when the vibrating membrane receives an ultrasonic wave, and includes an electrode provided opposite the vibrating membrane and configured to output a signal corresponding to a vibration state of the vibrating membrane.

4. The recording material determination apparatus according to claim 3, wherein, when the vibrating membrane receives an ultrasonic wave and vibrates, a change in capacitance between the vibrating membrane and the electrode is converted into the signal corresponding to the vibration state of the vibrating membrane.

5. The recording material determination apparatus according to claim 3, wherein a hole through which an ultrasonic wave passes is formed in the electrode, and the electrode is provided at a distance to the transmission unit that is smaller than a distance between the vibrating membrane and the transmission unit.

6. The recording material determination apparatus according to claim 1, wherein the reception unit is a micro-electromechanical system (MEMS) microphone.

7. The recording material determination apparatus according to claim 1, wherein the resonance frequency of the transmission unit is in a range of an ultrasonic wave.

8. The recording material determination apparatus according to claim 1, wherein a range of the audible sound is from 20 Hz to 20 kHz, and a range of the ultrasonic wave is greater than 20 kHz.

9. The recording material determination apparatus according to claim 1, wherein the reception unit is configured to output a signal which is not less than a predetermined voltage when the reception unit receives each of an ultrasonic wave and an audible sound.

10. The recording material determination apparatus according to claim 1, wherein a reception sensitivity of the reception unit at a frequency of the audible sound is not less than −40 voltage decibels (dBV).

11. An image forming apparatus comprising:

an image forming unit configured to form an image on a recording material;

a transmission unit configured to transmit an ultrasonic wave to the recording material;

a reception unit configured to vibrate when the reception unit receives the ultrasonic wave having been transmitted from the transmission unit and having passed through the recording material, and configured to output a signal corresponding to a vibration state; and a control unit configured to control an image forming condition for the recording material in accordance with the signal output from the reception unit, wherein a resonance frequency of the reception unit differs from a resonance frequency of the transmission unit, and the resonance frequency of the reception unit is in a range of an audible sound.

12. The image forming apparatus according to claim 11, wherein a first reception sensitivity of the resonance frequency of the reception unit of the ultrasonic wave transmitted from the transmission unit is not less than −45 voltage decibels (dBV) and is lower than a second reception sensitivity at the reception unit resonance frequency by not less than 6 dBV.

13. The image forming apparatus according to claim 11, wherein the reception unit includes a vibrating membrane configured to vibrate when the vibrating membrane receives an ultrasonic wave, and includes an electrode provided opposite the vibrating membrane and configured to output a signal corresponding to a vibration state of the vibrating membrane.

14. The image forming apparatus according to claim 13, wherein, when the vibrating membrane receives an ultrasonic wave and vibrates, a change in capacitance between the vibrating membrane and the electrode is converted into the signal corresponding to the vibration state of the vibrating membrane.

15. The image forming apparatus according to claim 13, wherein a hole through which an ultrasonic wave passes is formed in the electrode, and the electrode is provided at a distance to the transmission unit that is smaller than a distance between the vibrating membrane and the transmission unit.

16. The image forming apparatus according to claim 11 further comprising a conveyance unit configured to convey the recording material, wherein a detection operation, in which the transmission unit transmits an ultrasonic wave and the reception unit receives the ultrasonic wave having passed through the recording material and outputs a signal, is performed a plurality of times on the recording material being conveyed by the conveyance unit.

17. The image forming apparatus according to claim 11, wherein the image forming condition includes at least any one of a conveyance speed of the recording material, a voltage value applied to a transfer unit included in the image forming unit when the transfer unit transfers an image onto the recording material, and a temperature at which a fixing unit included in the image forming unit fixes an image to the recording material.

18. The image forming apparatus according to claim 11, wherein the reception unit is a micro-electro-mechanical system (MEMS) microphone.

19. The image forming apparatus according to claim 11, wherein the resonance frequency of the transmission unit is in a range of an ultrasonic wave.

20. The image forming apparatus according to claim 11, wherein a range of the audible sound is from 20 Hz to 20 kHz, and a range of the ultrasonic wave is greater than 20 kHz.

21. The image forming apparatus according to claim 11, wherein the reception unit is configured to output a signal which is not less than a predetermined voltage when the reception unit receives each of an ultrasonic wave and an audible sound.

22. The image forming apparatus according to claim 11, wherein a reception sensitivity of the reception unit at a frequency of the audible sound is not less than −40 voltage decibels (dBV).

* * * * *